US008807208B1

(12) United States Patent
Keast

(10) Patent No.: US 8,807,208 B1
(45) **Date of Patent: *Aug. 19, 2014**

(54) METHOD FOR USING A POWER SWIVEL WITH TILT

(71) Applicant: Larry G. Keast, Houston, TX (US)

(72) Inventor: Larry G. Keast, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/261,330

(22) Filed: Apr. 24, 2014

(51) Int. Cl.
*E21B 3/02* (2006.01)
*E21B 7/00* (2006.01)

(52) U.S. Cl.
CPC ..... *E21B 7/00* (2013.01)
USPC ..... 166/77.1; 166/75.11; 175/24

(58) Field of Classification Search
CPC ..... E21B 19/155
USPC ..... 166/75.11, 77.1; 175/24, 27, 40
See application file for complete search history.

(56) References Cited

U.S. PATENT DOCUMENTS 2,960,311 A * 11/1960 Scott ..... 173/141
3,766,991 A * 10/1973 Brown ..... 173/20
3,780,883 A * 12/1973 Brown ..... 414/22.62
4,890,681 A * 1/1990 Skelly ..... 173/218
5,794,723 A * 8/1998 Caneer et al. ..... 175/85
7,090,035 B2 * 8/2006 Lesko ..... 175/57
2006/0011350 A1 * 1/2006 Wiggins et al. ..... 166/379
2013/0011221 A1 * 1/2013 Mcintosh et al. ..... 414/22.51

* cited by examiner

*Primary Examiner* — William P Neuder
*Assistant Examiner* — Richard Alker
(74) *Attorney, Agent, or Firm* — Buskop Law Group, PC; Wendy Buskop

(57) ABSTRACT

A method for using a power swivel with tilt capable of being tilted to any angle up to an adjustable maximum tilt angle. The method allows adjusting the tilting power swivel's angle of tilt to line up with pipe staged at various angles as required by different rigs. The method allows for adjusting the maximum extension of the tilt cylinder, and further allows the power swivel to be repeatedly positioned at a desired angle for the duration of a job. The method requires the addition of only one hydraulic fluid supply hose, thereby allowing a simple live hose reel with four hoses. The method for using a power swivel with tilt promotes safety, efficiency, and saves time by eliminating the need for a stabbing man hanging in the derrick.

14 Claims, 9 Drawing Sheets

METHOD FOR USING A POWER SWIVEL WITH TILT

FIELD

The present embodiments generally relate to method for drilling using a power swivel that rotates a pipe string suspended from the traveling block of a drilling rig.

BACKGROUND

The present embodiments relate to methods for drilling new wells and servicing old wells beneath the earth's surface.

A need exists for methods useful on a drilling rig that allows drilling that can be accomplished quickly, efficiently, and economically.

A further need exists for a method for drilling using a power swivel assembly suspended from a lifting means, such as a traveling block, forming a remote control tiltable power swivel assembly that allows remote control tilting to align the power swivel axis with pipe located in the opening in a derrick for passage of equipment, also referred to as a V-door.

The present embodiments meet these needs.

BRIEF DESCRIPTION OF THE DRAWINGS

The detailed description will be better understood in conjunction with the accompanying drawings as follows.

Figure 1A:
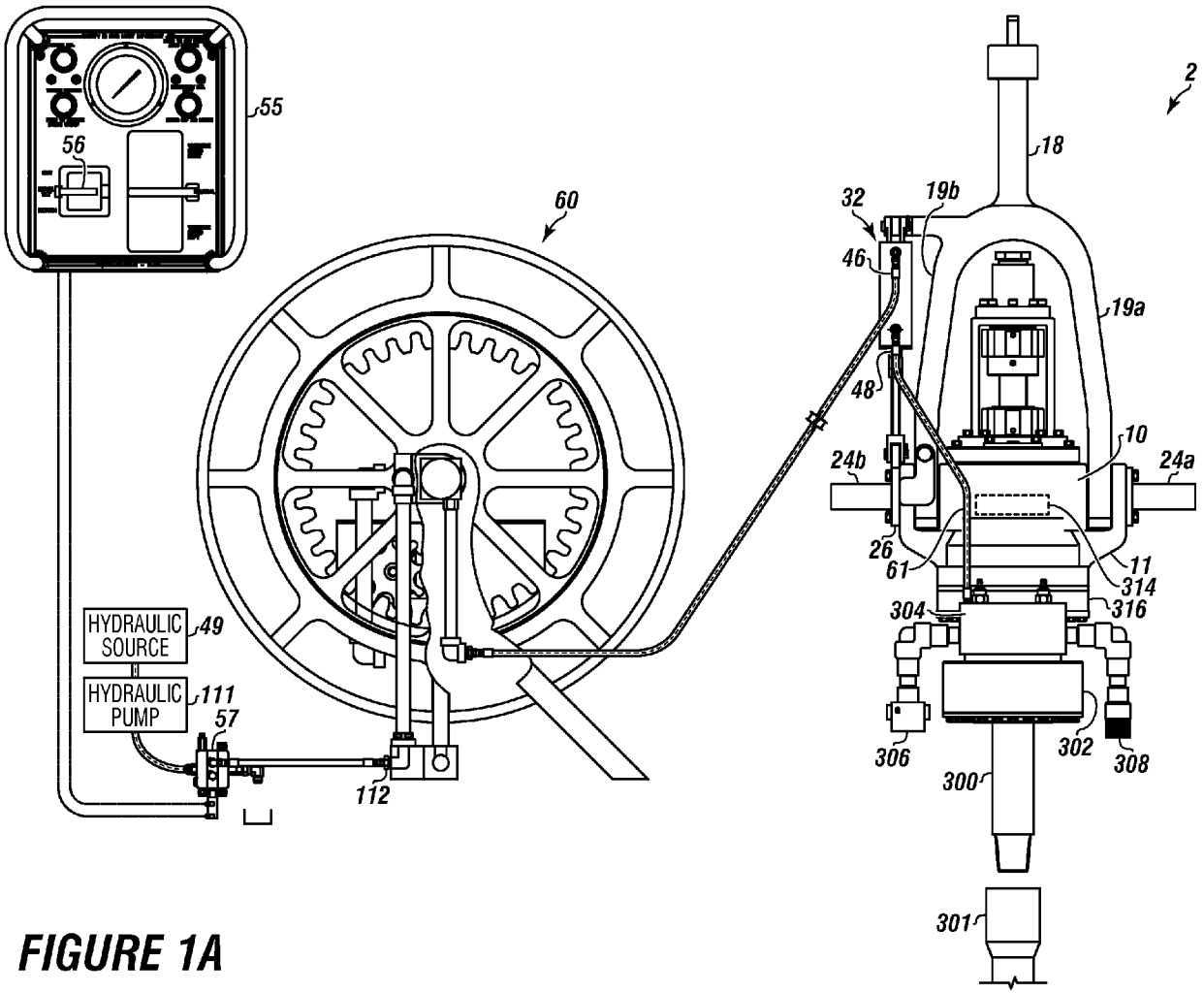
FIG. 1A depicts the remote controlled tilting power swivel assembly usable with the method.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

Power swivel is an industry term known to persons having ordinary skill in the art to describe a drilling machine used with tubulars or drill pipes in oil well operations. A typical power swivel performs at least the following basic functions: providing torque for pipe rotation, supporting the weight of a rotating pipe, housing a sealing arrangement to allow for the pumping of high pressure drilling fluids.

The present invention provides a method of using a power swivel assembly accommodating the needs listed above for use with a drilling rig mast or derrick. The present invention allows for a method of utilizing a tilt function of the power swivel allowing greater safety, as well as cost and time savings in the manipulation of tubulars or drill pipes.

A benefit of various embodiments is that the invention provides a method for accommodating drill pipe at an angle, by tilting a power swivel attached to a lifting means, such as a traveling block, through mechanical actuation with a hydraulic cylinder, and can be remotely operable.

The invention relates to a method for drilling using a remote controlled tilting power swivel assembly attached to a lifting means of a drilling rig for rotating tubulars to drill into a wellbore.

In embodiments, the remote controlled tilting power swivel assembly usable to employ the method can have a tilt cylinder assembly attached between a power swivel housing and a connecting means for engaging a lifting means of the drilling rig.

The power swivel assembly incorporates a power swivel and a tilt cylinder assembly.

In embodiments of the method, the tilt cylinder assembly is powered in part by hydraulic fluid from the power swivel, and powered in part from a separate hydraulic fluid line connected to the tilt cylinder assembly. This novel arrangement allows for the operation of the tilt function with the addition of only one hydraulic hose to existing equipment, resulting in cost savings and allowing all required hoses to be rolled up on a single hose reel.

As used herein, the term "hose" can refer to any fluid conduit used for supplying hydraulic fluids or other fluids.

In embodiments of the method, a separate hydraulic fluid line can pass through a hydraulic hose reel assembly. A commonly used hydraulic hose reel assembly for a power swivel has three hoses including two hydraulic supply hoses and a drain hose.

The present invention is a method of use for using the added tilt function of the power swivel with the addition of a fourth hose, which can be accomplished with minimal modification to the hydraulic hose reel assembly and the power swivel.

In embodiments of the method, the separate hydraulic fluid line can be controlled by a tilt valve connected to a hydraulic pump, or any commonly used means of supplying or flowing hydraulic fluid.

In embodiments of the method, the tilt valve is fluidly controlled by a hydraulic remote control that can be operated to "tilt" or "retract" the power swivel as the power swivel is connected to the connecting means engaging the lifting means of the drilling rig.

As used herein, the term "tilt" refers to angling or orientation of the power swivel away from a substantially vertical position and "retract" refers to angling or orientation of the power swivel toward a substantially vertical position. The "substantially vertical position" refers to when the power swivel is positioned directly above the wellbore.

The hydraulic remote control can cause the power swivel to rotate toward or away from a substantially vertical position, up to an orientation of 90 degrees in relation to the substantially vertical position.

The tiltable remote controlled power swivel enables picking up and inserting tubulars or drill pipes into the wellbore in a manner that is safer than non-tilting power swivels. For example, tubulars or drill pipes can be staged at an angle on a pipe rack and engaged by the power swivel when tilted.

The method enables this manipulation and engagement of a tubular that is not vertical, and further facilitates alignment and placement of the tubular with minimal involvement from the operators. This, in turn, allows for safer operation at a well site with less chance for operator injury, equipment damage, and other undesirable outcomes.

The method uses an inventive power swivel assembly which comprises a connecting means that attaches to a lifting means of a derrick for drilling oil or water wells, natural gas wells, and the like.

The method uses an inventive power swivel that can have a power swivel housing for containing the power swivel components.

The power swivel can include a rotating drive shaft also referred to as a stem, which is rotatable on an axis.

The power swivel can receive hydraulic fluid to operate. In embodiments, this hydraulic fluid is supplied by two main hoses from the hydraulic hose reel assembly. The rotating drive shaft can rotate at various rotational speeds as desired.

Within the field of drilling, in general, power swivels can simultaneously suspend the weight of a drill string and provide for the rotation of the drill string beneath it. A power swivel includes a stationary part that is coupled with a power source and, in embodiments, can be in communication with hydraulic motors and a rotating part that is coupled with a drill string. A power swivel can further provide a sealed pathway for high-volume flow of drilling mud or air from the stationary part to the rotating part.

For example, in oilfield applications, hydraulic motors can cause a drive shaft of the power swivel to rotate which can also be connected to a drill string. By rotating the drill string a drill bit rotates and cuts through the strata.

Typical size bore holes can range from about 1.25 inches in diameter to about 12.75 inches in diameter; although larger scale equipment can be used to produce larger holes.

The power swivel comprises all required working components, including, but not limited to a motor, a shaft, a brake assembly, a thrust bearing assembly and a connecting means for engaging a lifting means.

The method can make use of various embodiments of the power swivel. The power swivel described herein relates to fluid drilling. The present invention can utilize water or mud drilling techniques as well. Similarly, air drilling, mist drilling, foam drilling and other drilling techniques can be usable with the method.

Turning now to the Figures, FIG. 1A depicts a remote controlled tilting power swivel assembly usable with the method.

The remote controlled tilting power swivel assembly 2 can include a power swivel 10.

The power swivel 10 can be attached to lifting means of a drilling rig. The power swivel can be a remote controlled tilting power swivel.

In an embodiment, the lifting means can be a lifting block, such as a traveling block connected to the hoist system of a derrick or tower, or another form of lifting device, such as a links connected to the hoist system of a derrick.

The remote controlled tilting power swivel assembly 2 can be attached to a connecting means 18, which is depicted as an elevator bail. The connecting means can comprise a first side 19*a* extending over one side of a power swivel 10 and a second side 19*b* extending over an opposite side of the power swivel 10.

In embodiments, the connecting means 18 can be secured to the power swivel with a means of connecting 24*a* and 24*b*, such as a pair of bail pins that extend into a power swivel housing 11 of the power swivel 10.

One of the bail pins 24*a* can secure the power swivel 10 to the first side 19*a* of the connecting means and through the power swivel housing 11, and the other bail pin 24*b* can secure through the power swivel housing 11 attaching the power swivel 10 to the second side 19*b* of the connecting means.

A tilt plate 26 can be mounted to the power swivel housing 11 and around the bail pin 24*b*.

A tilt valve 57 can be in fluid communication between a hydraulic remote control 55 and a tilt cylinder assembly 32. The fluid in this embodiment is hydraulic fluid. While one embodiment of remote control is shown here, various arrangements of valves and types of control can be used.

The tilt valve 57 can provide fluid to an extend port 46. In embodiments, a lever 56 on the hydraulic remote control 55 can actuate the tilt valve 57 to tilt the power swivel, allowing fluid to flow into the extend port 46.

The hydraulic remote control 55 can retract the power swivel by causing hydraulic fluid to flow from the power swivel into a retract port 48 of the tilt cylinder assembly 32.

In embodiments, the tilt valve causes hydraulic fluid to enter the extend port on the tilt cylinder assembly 32, extending the cylinder, thus tilting the power swivel at an angle away from a substantially vertical position until rotation of the power swivel is stopped.

A means of retracting the power swivel can be housed within the valve manifold block 304 on the cylinder.

Embodiments of the power swivel can include a stem 300 for connecting to a tubular 301 extending from the power swivel housing 11 for pushing into the wellbore.

The power swivel can include a brake 302 swivel and a valve manifold block 304 adjacent the brake.

A first power swivel port 306 and a second power swivel port 308, in embodiments, can allow for the flowing of hydraulic fluid into the power swivel 10. A thrust bearing 314 can be in the power swivel housing and connect to the stem. A hydraulic motor 316 can rotate the stem supported by the thrust bearing.

In embodiments, the means of retracting can include one or more check valves and a valve for reducing and relieving pressure. In embodiments, the means of retracting can be connected to a retract hose 61 for flowing hydraulic fluid to the retract cylinder.

In embodiments, the hydraulic fluid can be moved through the tilt valve 57 with a hydraulic pump 111.

In embodiments, the remote controlled tilting power swivel assembly 2 can include a hydraulic hose reel assembly 60 fluidly connected between the tilt valve 57 and the extend port 46.

A port 112 for flowing hydraulic fluid from the hydraulic source 49 is also shown.

Figure 1B:
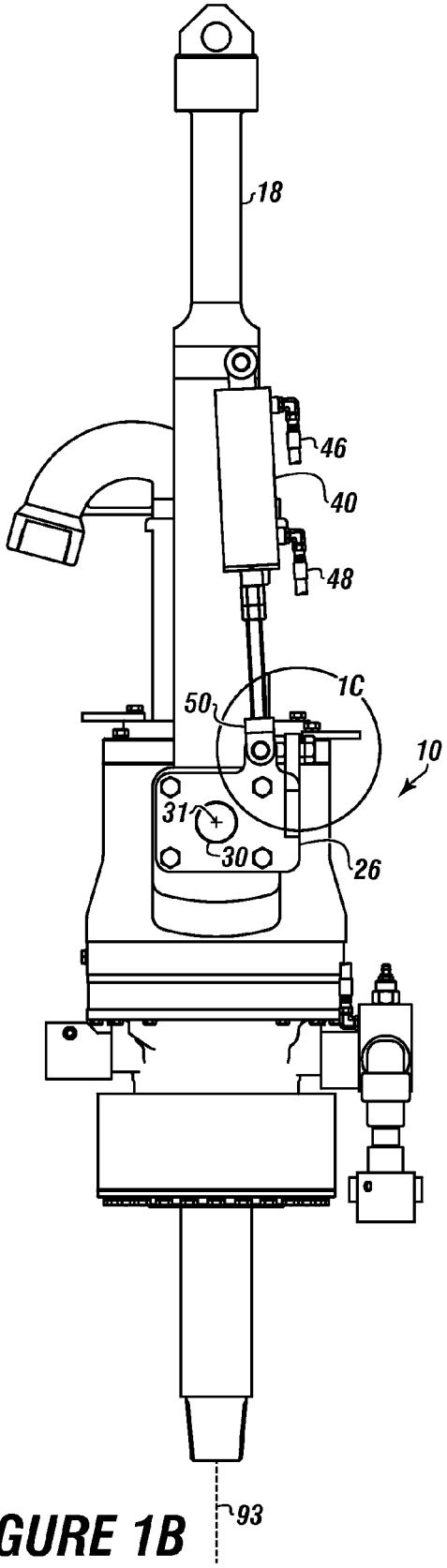
FIG. 1B depicts a side view of the power swivel with a tilt plate.
Figure 1C:
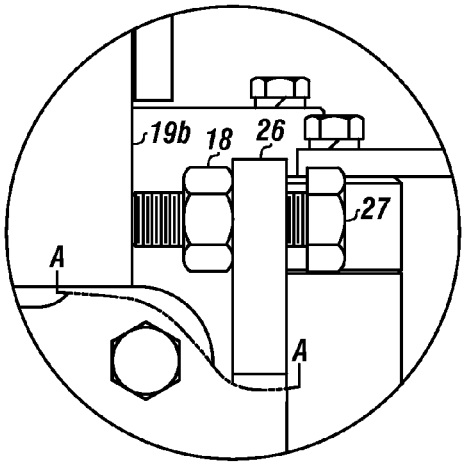
FIG. 1C depicts a detail view of the tilt plate.

FIG. 1B depicts a side view of the power swivel with a tilt plate. FIG. 1C depicts a detail view of the tilt plate.

Referring to FIGS. 1B and 1C, the power swivel 10 can include a tilt plate 26. The tilt plate 26, in embodiments, can have a thru hole 30, wherein a bail pin can penetrate through the tilt plate 26 into the power swivel housing.

One or more valves within the valve manifold block can flow hydraulic fluid into the retract port 48, retracting the power swivel until limited by an adjustable stop.

The means of retracting can be used to move the power swivel from its tilted angle back toward a substantially vertical position. The exact orientation of the power swivel can be adjustable using the adjustable stop 27. The adjustable stop is adjustable for different angles around a center point 31 of the thru hole 30.

The adjustable stop 27 can be mounted to the tilt plate 26. In embodiments, the adjustable stop can engage a tilt plate clevis 50 which can be connected to the cylinder of the tilt cylinder assembly.

In embodiments, the adjustable stop 27 can be fixed in position using a lock nut 18. The adjustable stop 27 can limit the rotation of the power swivel at a substantially vertical position.

The stem of the power swivel can be rotatable on an axis 93.

The connecting means 18 with the second side 19*b* and the extend port 46 are also shown.

Figure 2:
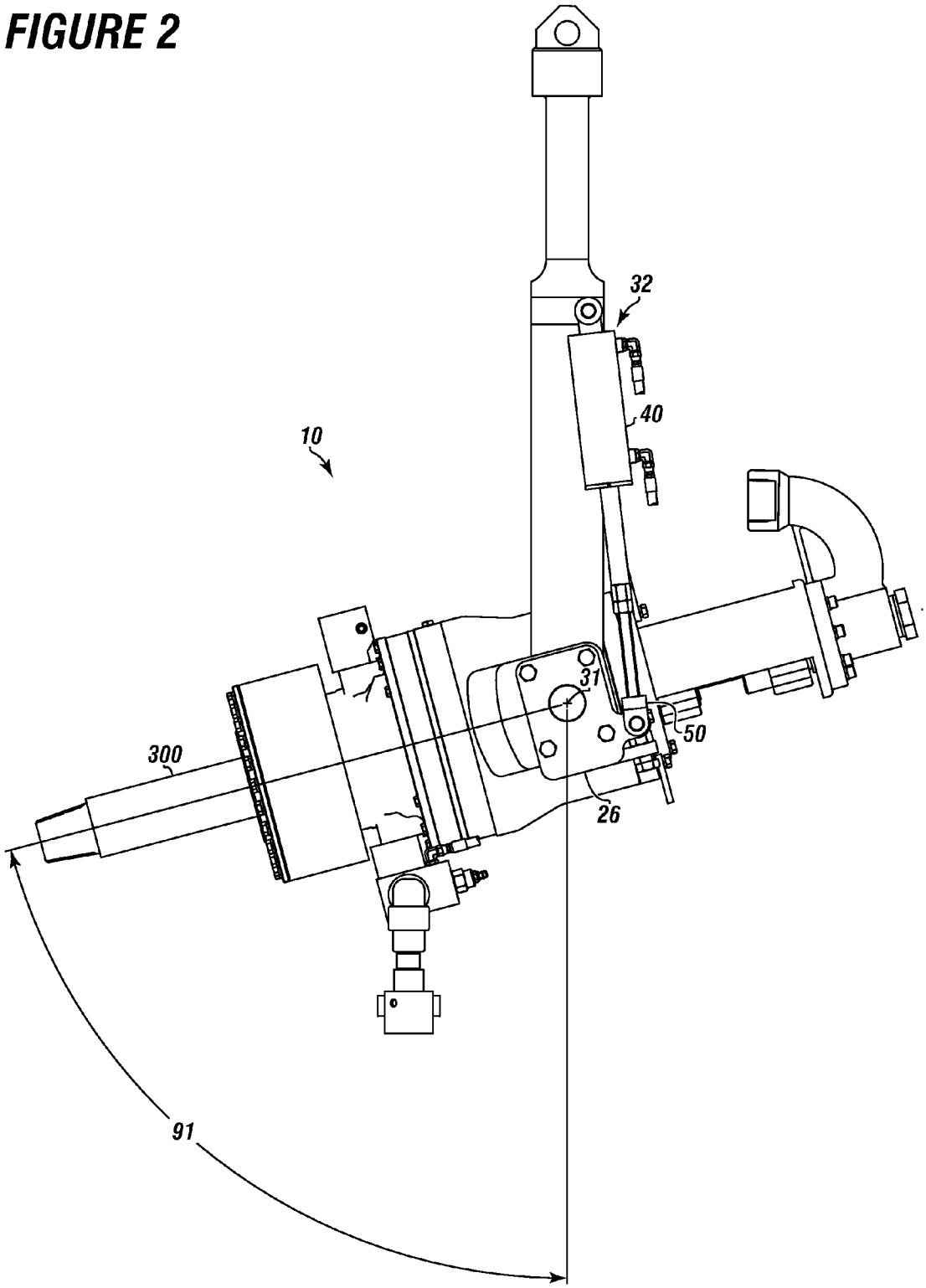
FIG. 2 depicts a side view of the power swivel tilted away from a substantially vertical position.

FIG. 2 depicts a side view of the power swivel tilted away from a substantially vertical position.

When the tilt cylinder assembly 32 extends the cylinder 40, the power swivel 10 can tilt away from a substantially vertical position and can be tilted up to a full extension of the cylinder. When the cylinder retracts, the power swivel can be rotated in an opposite direction to be repositioned at a desired angle within the range of rotation. The tilt cylinder assembly 32 can control tilting of the power swivel 10 about the center point 31 to a tilt angle 91. The full extension of the cylinder can be adjusted to control the tilt angle 91. The tilt angle can be a preset tilt angle.

In embodiments, the plate 26 can comprise a tilt plate clevis 50.

Figure 3:
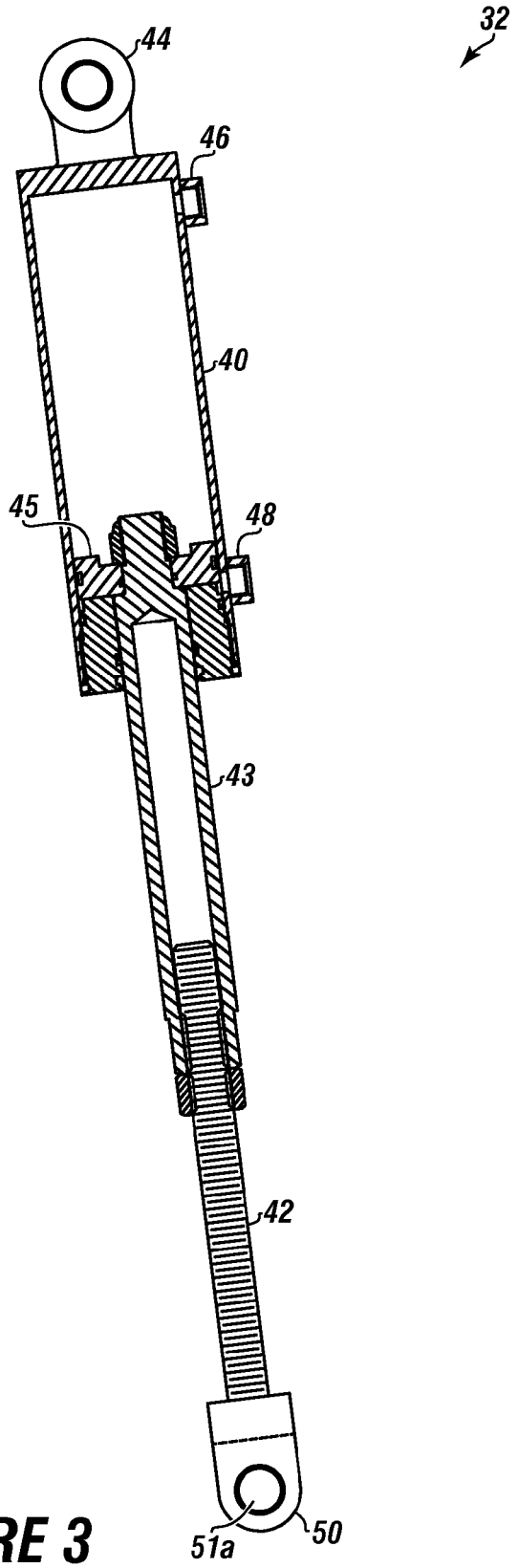
FIG. 3 depicts an embodiment of the tilt cylinder assembly.

FIG. 3 depicts an embodiment of the tilt cylinder assembly.

In this embodiment, one manner in which the full extension of the cylinder can be adjusted is shown. The present detail is shown in an extended orientation, when the power swivel has been angled with respect to the wellbore.

The tilt cylinder assembly 32 can have a cylinder 40 which can be hydraulic. Inserted into the cylinder 40 on one end can be a hollow piston rod 43.

In embodiments, the extension of the tilt cylinder assembly can be adjusted by using a threaded rod 42 which can be threaded inside of the hollow piston rod 43 which can be extended and retracted by the cylinder 40. The full rotational range can be adjusted by manipulating the extended length of the threaded rod 42.

In embodiments, the threaded rod can adjustably extend from the cylinder, in that the threaded rod can be threaded into or out of the cylinder, and so long as the threads engage the hollow piston rod, the tilt cylinder assembly can operate to tilt the power swivel.

In embodiments, the tilt cylinder assembly 32 can engage the connecting means on a side opposite the tilt plate.

The threaded rod can adjust from 0.5 inches to 15 inches in embodiments into and away from the hollow piston rod.

In embodiments, a piston 45 in the cylinder 40 can be connected to the hollow piston rod 43. The piston can be used to extend or retract the hollow piston rod.

In embodiments, a cylinder attachment 44, such as a bail attachment clevis, can connect the cylinder 40 to the connecting means.

In embodiments, the cylinder can have an extend port 46 for receiving hydraulic fluid into the body of the cylinder, allowing the hydraulic fluid to extend the hollow piston rod 43.

The cylinder can also have a retract port 48 for receiving hydraulic fluid into the body of the cylinder, allowing the hydraulic fluid to push on the piston and the hollow piston rod and retract into the body of the cylinder, in part.

The tilt cylinder assembly 32 can include a tilt plate clevis 50 secured to the threaded rod 42, opposite the cylinder. The tilt plate clevis 50 can secure the tilt cylinder assembly 32 to the tilt plate.

A pin 51*a* can secure a tilt plate clevis 50 moveably to the tilt plate.

In embodiments, the hydraulic remote control can contain other meters and gauges for operating the power swivel on the rig. However, the hydraulic remote control controls power swivel tilting while keeping the operator a safe distance from the power swivel's moving components.

Figure 4:
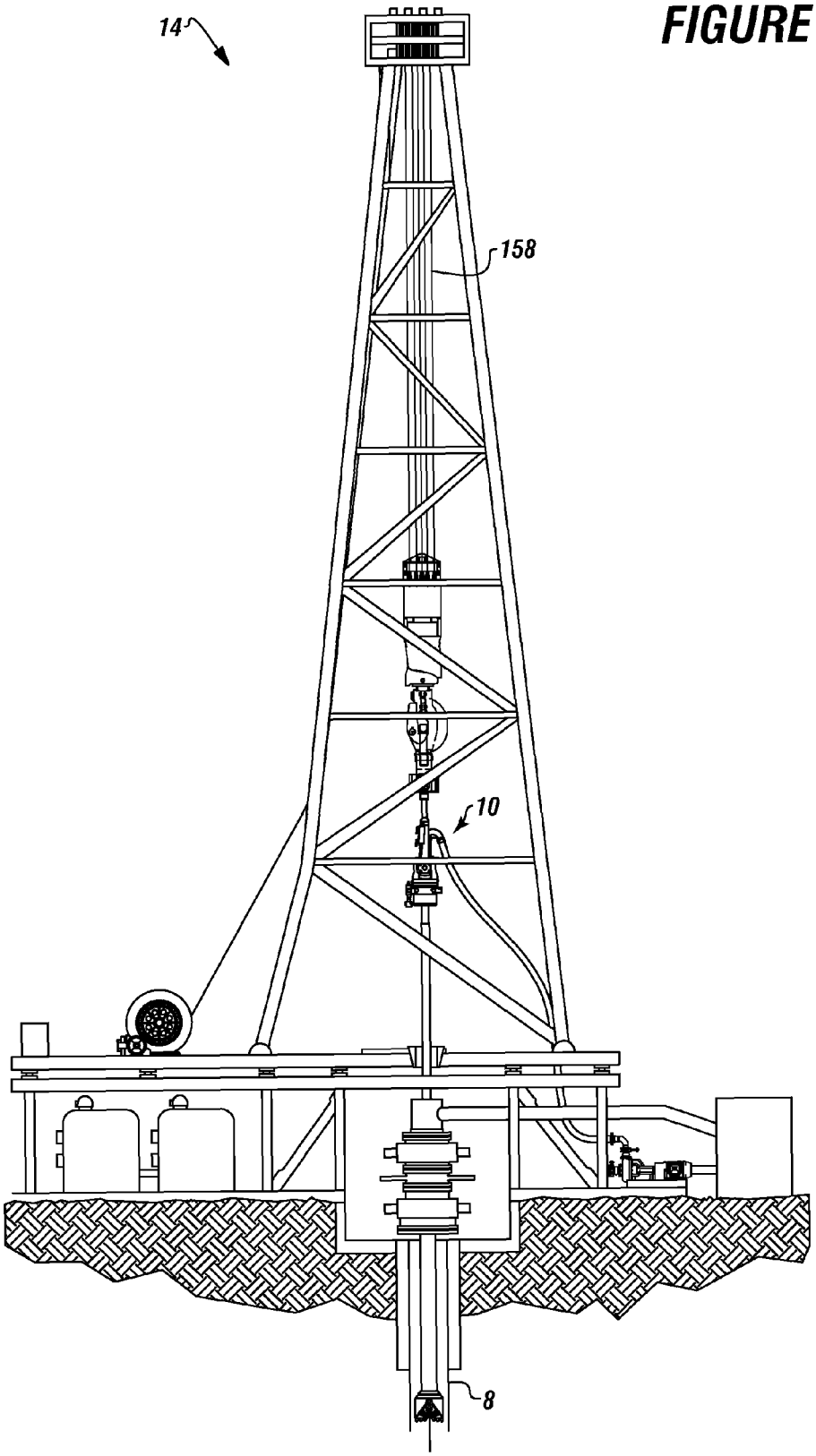
FIG. 4 depicts a power swivel installed on a drilling rig.

FIG. 4 depicts a power swivel 10 installed on a drilling rig 14 over a wellbore 8. Also shown is the lifting means 158 of the derrick.

Figure 5:
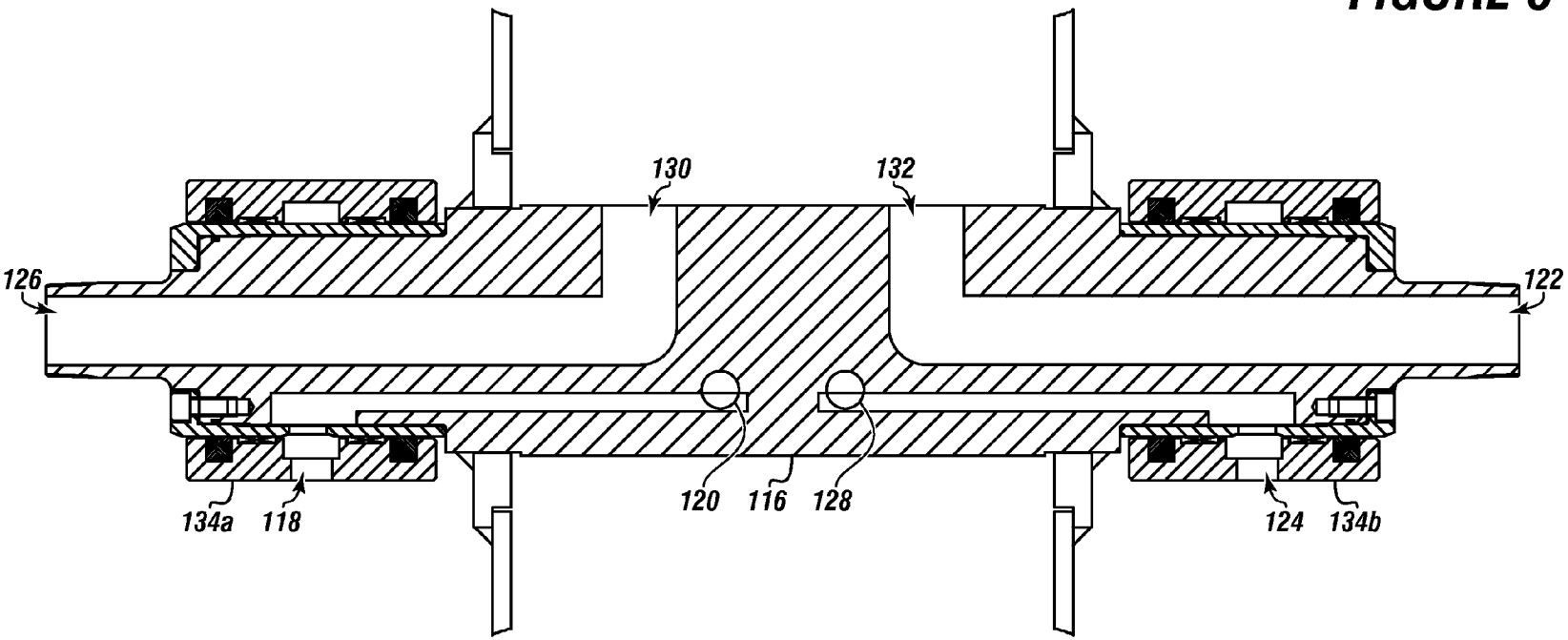
FIG. 5 depicts a detail of an embodiment of an axle of the hydraulic hose reel assembly.

FIG. 5 depicts a detail of an embodiment of an axle of the hydraulic hose reel assembly.

While embodiments with a fixed axle are easily implemented, FIG. 5 depicts a rotating axle for use with a hydraulic hose reel assembly.

Swivel joint assemblies 134*a* and 134*b* can be disposed proximate each end of the axle 116. The fluid pathway to ports 120 and 128 can be maintained even while the axle is rotating.

Embodiments of the axle of a hydraulic hose reel assembly can have a plurality of ports 118, 120, 122, 124, 126, 128, 130 and 132 for flowing hydraulic fluid. In embodiments, the ports can function as inlet ports, outlet ports, or combinations thereof. Ports 120 and 128 can function as an axle tilt port and an axle drain port. The hydraulic fluid can flow bidirectionally through any of the plurality of ports as needed.

Ports 122 and 132 can be disposed on either end of a fluid conduit through the axle. Similarly, ports 126 and 130, ports 124 and 128, and ports 118 and 120 can all define separate fluid conduits.

The ports and the associated fluid conduits can be in communication with a rotational mechanism of the power swivel, a tilt mechanism of the power swivel, or for draining fluid from the power swivel. Various hoses can be attached to accomplish this purpose.

In embodiments, the hydraulic hose reel can flow hydraulic fluid to power the rotational mechanism of the power swivel, conduct drain fluid, or power the tilt mechanism. Various hoses can be attached to accomplish this purpose.

For example, an embodiment can use two hoses with the hydraulic hose reel in fluid communication with ports 130 and 132 and the power swivel to supply hydraulic fluid to power the rotational mechanism of the power swivel. A third hose can be in fluid communication with port 120 and to a drain of the power swivel, and a fourth hose can be in fluid communication with port 128 and the tilt cylinder assembly.

Figure 6A:
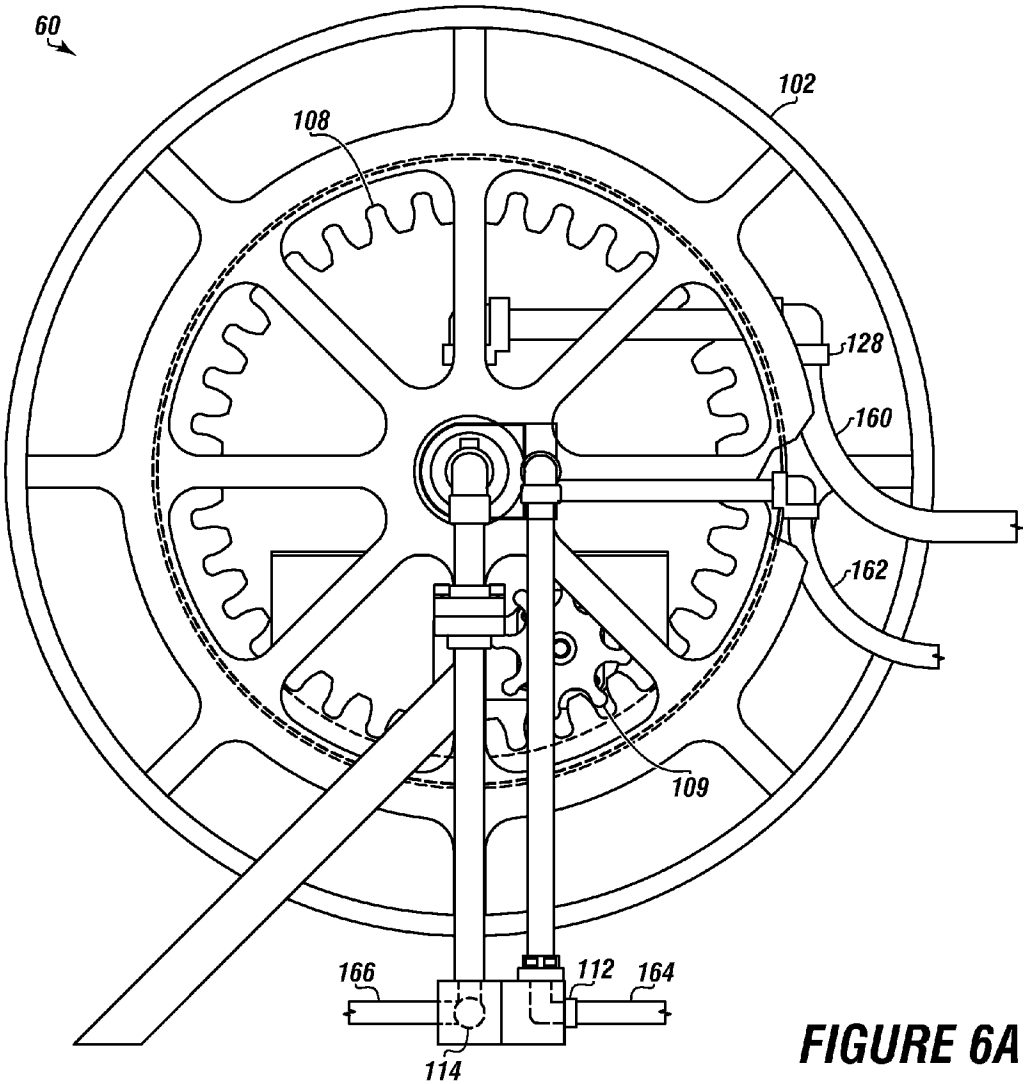
FIGS. 6A and 6B depict a hydraulic hose reel assembly.
Figure 6B:
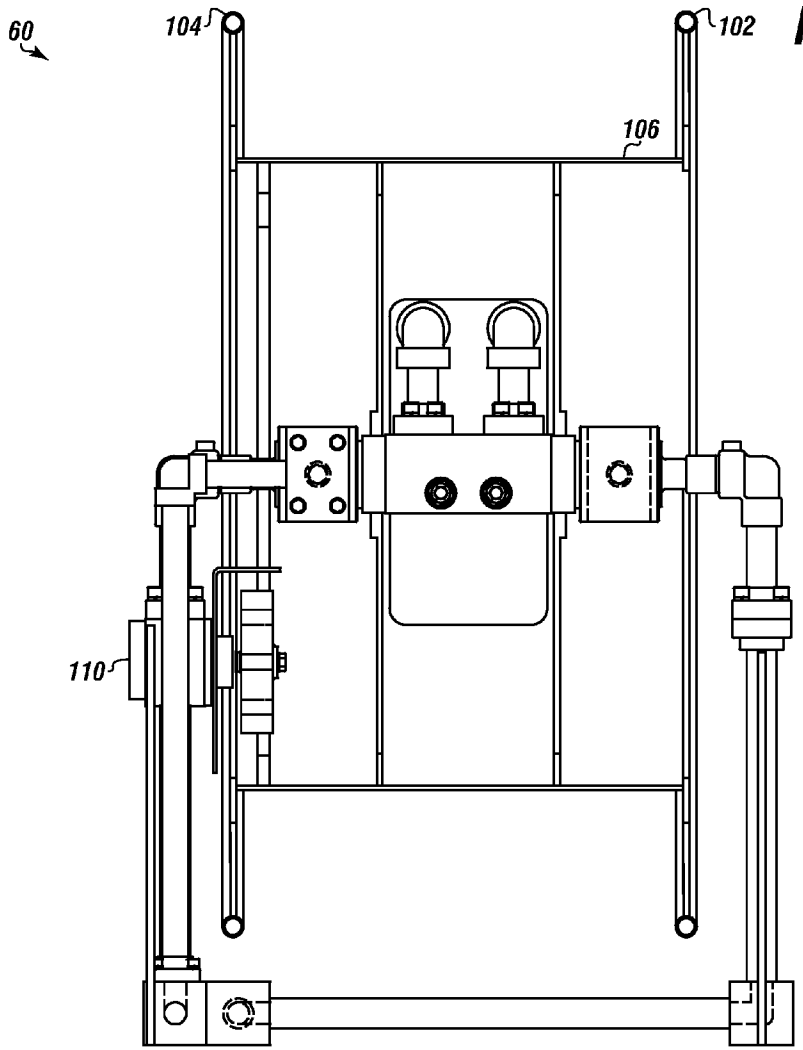

FIGS. 6A and 6B depict a hydraulic hose reel assembly.

In embodiments, the hydraulic hose reel assembly 60 can have a first wheel 102, a second wheel 104, a drum 106 mounted between the wheels, a ring gear 108 secured to the drum 106, a pinion gear 109 connected to the ring gear, and a drive motor 110 connected to the pinion gear. Ports 112, 114 and 128 for flowing hydraulic fluid are shown.

In embodiments, a drive motor 110 can connect to a pinion gear rotating the pinion engaging with the ring gear thereby rotating the wheels and drum.

In embodiments, the hydraulic hose reel assembly can have four separate fluid flow pathways.

The hydraulic hose reel assembly 60 can have a plurality of hoses for hydraulic fluid. The first hose 160 and second hose 162 can be in fluid communication with a rotational mechanism of the power swivel. The third hose 164 can be in fluid communication with a drain of the rotational mechanism of the power swivel. The fourth hose 166 can be in fluid communication with the power swivel, for supplying the hydraulic fluid to tilt the power swivel.

Figure 7:
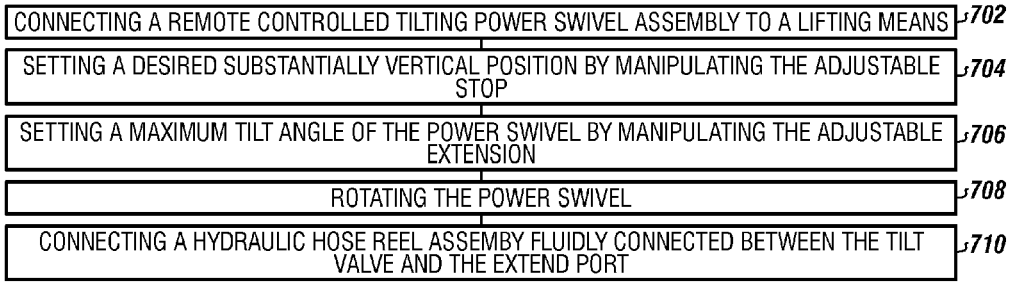
FIG. 7 depicts the steps of the method for using a power swivel with tilt.

FIG. 7 depicts the steps of the method for using a power swivel with tilt.

The method can include connecting a remote controlled tilting power swivel assembly to a lifting means, as shown in step 702. The lifting means can be connected to a drilling rig for drilling a wellbore.

The method can include setting a desired substantially vertical position by manipulating the adjustable stop, as shown in step 704.

The method can include setting a maximum tilt angle of the power swivel by manipulating the adjustable extension, as shown in step 706. In embodiments, setting the maximum tilt angle can comprise rotating the threaded rod clockwise or counter-clockwise to modify the full extension of the cylinder.

The method can include rotating the power swivel, as shown in step 708. The power swivel can be rotated by either causing hydraulic fluid to flow into the extend port to tilt the power swivel to a desired orientation up to the maximum tilt angle, or causing hydraulic fluid to flow into the retract port to retract the power swivel.

In embodiments, the method can also include connecting a hydraulic hose reel assembly fluidly connected between the tilt valve and the extend port, as shown in step 710.

While these embodiments have been described with emphasis on the embodiments, it should be understood that within the scope of the appended claims, the embodiments might be practiced other than as specifically described herein.

What is claimed is:

1. A method for using a remote controlled tilting power swivel assembly, the method comprising:

a. connecting the remote controlled tilting power swivel assembly to a lifting means of a drilling rig for drilling a wellbore, wherein the remote controlled tilting power swivel assembly comprises:
   (i) a connecting means for engaging the lifting means;
   (ii) a power swivel having a power swivel housing, movably connected to the connecting means;
   (iii) a means of connecting the power swivel moveably to the connecting means;
   (iv) a tilt plate secured to the power swivel housing, the tilt plate comprising:
      1. a thru hole, configured to enable the means of connecting to penetrate through the tilt plate into the power swivel housing; and
      2. an adjustable stop mounted to the tilt plate, wherein the adjustable stop is adjustable to control positioning of the power swivel at a substantially vertical position;
   (v) a tilt cylinder assembly connected to the connecting means on a side opposite the tilt plate, the tilt cylinder assembly comprising:
      1. a cylinder, wherein the cylinder comprises an adjustable extension;
      2. a cylinder attachment for connecting the cylinder to the connecting means;
      3. an extend port for communicating hydraulic fluid into the cylinder to extend the cylinder; and
      4. a retract port for communicating hydraulic fluid into the cylinder to retract the cylinder;
   (vi) a tilt valve in fluid communication with a hydraulic fluid source, wherein the tilt valve causes hydraulic fluid to enter the extend port, extending the cylinder, thereby tilting the power swivel away from the substantially vertical position until tilting of the power swivel up to a full extension of the cylinder;
   (vii) a retract valve mounted on the power swivel and connected to the hydraulic fluid source to the power swivel, wherein the retract valve flows hydraulic fluid into the retract port, retracting the cylinder, thereby retracting the power swivel toward the substantially vertical position; and
   (viii) a remote control for operating the tilt valve and the retract valve for controlling extending and retracting of the power swivel;
b. setting the desired substantially vertical position by manipulating the adjustable stop;
c. setting a maximum tilt angle of the power swivel by manipulating the adjustable extension;
d. rotating the power swivel by either:
   (i) causing hydraulic fluid to flow into the extend port to tilt the power swivel to a desired orientation up to the maximum tilt angle; or
   (ii) causing hydraulic fluid to flow into the retract port to retract the power swivel.

2. The method of claim 1, wherein the tilt cylinder further comprises a tilt plate clevis secured to a threaded rod, and wherein the tilt plate clevis is attached to the tilt plate, and wherein the adjustable extension comprises:

a. a hollow piston rod inserted in one end of the cylinder;
b. the threaded rod threadably engaged with the hollow piston rod for adjusting the full extension of the cylinder; and
c. a piston in the cylinder connected to the hollow piston rod.

3. The method claim 2, wherein setting the maximum tilt angle of the power swivel comprises rotating the threaded rod clockwise or counter-clockwise to modify the full extension of the cylinder.

4. The method of claim 1, further comprising connecting a hydraulic hose reel assembly fluidly connected between the tilt valve and the extend port.

5. The method of claim 4, wherein the hydraulic hose reel assembly comprises:

a. a first wheel;
b. a second wheel;
c. a drum mounted between the first wheel and the second wheel;
d. a drive motor for rotating the drum;
e. a plurality of inlet ports for receiving hydraulic fluid;
f. a plurality of outlet ports for flowing hydraulic fluid from the hydraulic hose reel assembly; and
g. an axle disposed between the first wheel and the second wheel and in communication with the drum, allowing the wheels and the drum to rotate.

6. The method of claim 5, wherein the hydraulic hose reel assembly comprises four inlet ports and four outlet ports.

7. The method of claim 6, wherein the axle further comprises an axle tilt port and an axle drain port.

8. The method of claim 7, wherein the hydraulic hose reel assembly further comprises a pair of swivel joint assemblies, wherein each swivel joint assembly is disposed proximate to opposite ends of the axle, and further wherein each swivel joint assembly fluidly communicates with a respective fluid pathway to the axle tilt port and the axle drain port.

9. The method of claim 8, wherein each swivel joint assembly fluidly communicates with the respective fluid pathway while the axle is rotating.

10. The method of claim 6, wherein, the hydraulic hose reel assembly further comprises:

a. a first hose for hydraulic fluid in fluid communication with a rotational mechanism of the power swivel;
b. a second hose for hydraulic fluid in fluid communication with the rotational mechanism of the power swivel;
c. a third hose in fluid communication with a drain of the rotational mechanism of the power swivel; and
d. a fourth hose for hydraulic fluid in fluid communication with the power swivel, for supplying the hydraulic fluid to tilt the power swivel.

11. The method of claim 6, wherein the hydraulic hose reel assembly supplies the hydraulic fluid for tilting the power swivel with a single fluid conduit.

12. The method of claim 11, wherein hydraulic fluid for retracting the power swivel is hydraulic fluid for actuating a rotational mechanism of the power swivel.

13. The method of claim 1, wherein the connecting means is either a pair of link hooks or a pair of links.

14. The method of claim 1, wherein the power swivel further comprises:

a. a stem for connecting to a tubular extending from the power swivel housing;

b. a thrust bearing in the power swivel housing connected to the stem; and c. a hydraulic motor that rotates the thrust bearing as connected to the stem.

* * * * *